US012628913B2

(12) United States Patent
Bergman

(10) Patent No.: US 12,628,913 B2
(45) Date of Patent: May 19, 2026

(54) PROTECTIVE SHOELACE COVER FOR FOOTWEAR

(71) Applicant: LAP Creations LLC, New York, NY (US)

(72) Inventor: Sara Bergman, White Plains, NY (US)

(73) Assignee: LAP Creations LLC, New York, NY (US)

( * ) Notice: Subject to any disclaimer, the term of this patent is extended or adjusted under 35 U.S.C. 154(b) by 452 days.

(21) Appl. No.: 18/016,757

(22) PCT Filed: Jul. 23, 2021

(86) PCT No.: PCT/US2021/042980
§ 371 (c)(1),
(2) Date: Jan. 18, 2023

(87) PCT Pub. No.: WO2022/026324
PCT Pub. Date: Feb. 3, 2022

(65) Prior Publication Data

US 2025/0089852 A1 Mar. 20, 2025

Related U.S. Application Data

(60) Provisional application No. 63/057,614, filed on Jul. 28, 2020.

(51) Int. Cl.
*A43C 13/02* (2006.01)
*A43B 3/00* (2022.01)
(Continued)

(52) U.S. Cl.
CPC ..... *A43C 13/02* (2013.01); *A43B 3/0078* (2013.01); *A43B 23/24* (2013.01); *A43C 7/02* (2013.01);
(Continued)

(58) Field of Classification Search
CPC .. A43C 7/02; A43C 7/04; A43C 11/20; A43C 11/24; A43C 13/02; A43B 3/0078; A43B 23/24
(Continued)

(56) References Cited

U.S. PATENT DOCUMENTS 728,959 A 5/1903 Morse
2,022,554 A 11/1935 Williams
(Continued)

FOREIGN PATENT DOCUMENTS

CH 710 590 7/2016
KR 20-0425447 9/2006
(Continued)

OTHER PUBLICATIONS

Sabaton Foot Armor, Amazon.com, Downloaded Jun. 15, 2020.
(Continued)

*Primary Examiner* — Alissa J Tompkins
*Assistant Examiner* — Dakota Marin
(74) *Attorney, Agent, or Firm* — Wissing Miller LLP

(57) ABSTRACT

There is disclosed a shoelace protector for footwear formed by a plurality of plates arranged along a longitudinal axis. In use, the protector is connected with the laces of a shoe and extends along the laced portion of the shoe from a proximal end to a distal end of the laced portion. One or more linkages connect adjoining pairs of the plurality of plates. One or more proximal connectors are provided on the proximal edge of the proximal-most plate of the plurality of plates to connect the proximal end of the protector with an upper end of a laced portion of the shoe. One or more distal connectors are provided at or near the distal edge of the distal most plate to connect the protector with a lower end of the laced portion of the shoe.

17 Claims, 15 Drawing Sheets

(51) Int. Cl.

| | |
|---|---|
| *A43B 23/24* | (2006.01) |
| *A43C 7/02* | (2006.01) |
| *A43C 7/04* | (2006.01) |
| *A43C 11/20* | (2006.01) |
| *A43C 11/24* | (2006.01) |

(52) U.S. Cl.
CPC ..... *A43C 7/04* (2013.01); *A43C 11/20* (2013.01); *A43C 11/24* (2013.01)

(58) Field of Classification Search
USPC ..... 36/96, 54, 137, 72 R
See application file for complete search history.

(56) References Cited

U.S. PATENT DOCUMENTS

| | | | | | |
|---|---|---|---|---|---|
| 3,102,347 | A | 9/1963 | Griswold | | |
| 3,242,597 | A * | 3/1966 | George | A43C 13/14 | 36/72 R |
| 3,407,518 | A * | 10/1968 | Macquaid | A43C 13/14 | 36/72 R |
| 4,231,170 | A * | 11/1980 | Griswold | A43C 13/14 | 36/77 R |
| 4,333,248 | A * | 6/1982 | Samuels | A43C 13/14 | 36/129 |
| 4,536,975 | A | 8/1985 | Harrell | | |
| 4,733,439 | A * | 3/1988 | Gentry | A43C 11/22 | 24/575.1 |
| 5,165,190 | A | 11/1992 | Smyth | | |
| 5,209,000 | A | 5/1993 | Rowland | | |
| 5,307,569 | A | 5/1994 | Melcher | | |
| 5,313,719 | A | 5/1994 | Koethe | | |
| 5,416,987 | A | 5/1995 | Bernis | | |
| 5,566,477 | A * | 10/1996 | Mathis | A43B 3/24 | 36/132 |
| D375,618 | S | 11/1996 | Chen | | |
| D377,410 | S | 1/1997 | Crowley | | |
| D456,121 | S | 4/2002 | Smith, III | | |
| D456,596 | S | 5/2002 | Hannah | | |
| 6,588,078 | B2 * | 7/2003 | Writt | A43B 23/26 | 24/712.2 |
| 6,601,323 | B2 * | 8/2003 | Tsujino | A43C 7/02 | 24/712.3 |
| D509,348 | S | 9/2005 | Brewer | | |
| 6,952,864 | B2 * | 10/2005 | Moreno | A43C 7/02 | 24/306 |
| D601,792 | S | 10/2009 | Kennedy | | |
| D615,285 | S | 5/2010 | Martin | | |
| 8,332,994 | B2 * | 12/2012 | Lin | A43C 1/00 | 24/712.6 |
| 8,438,708 | B1 * | 5/2013 | Tuck | A43C 7/02 | 36/1 |
| D714,536 | S | 10/2014 | Lee | | |
| D715,532 | S | 10/2014 | Pappas | | |
| 8,914,915 | B1 | 12/2014 | Alari | | |
| 9,009,992 | B2 | 4/2015 | Baker | | |
| D765,965 | S | 9/2016 | Kaupelis | | |
| 10,779,706 | B1 * | 9/2020 | Gonzales | A43B 23/0245 | |
| 11,096,448 | B1 * | 8/2021 | Hodge | A43B 23/26 | |
| 11,330,867 | B2 * | 5/2022 | Craven, Sr. | A43C 1/00 | |
| 2002/0029494 | A1 * | 3/2002 | Small | A43B 3/0078 | 36/100 |
| 2009/0205175 | A1 * | 8/2009 | Han | A43C 11/22 | 24/712.1 |
| 2010/0071230 | A1 * | 3/2010 | Hassid | A43C 11/20 | 36/50.1 |
| 2010/0192337 | A1 * | 8/2010 | LaPlante | A43C 13/00 | 24/712 |
| 2013/0019508 | A1 * | 1/2013 | Smith | A43B 23/0265 | 36/72 R |
| 2013/0081308 | A1 * | 4/2013 | Woods | A43B 3/163 | 36/72 R |
| 2014/0082962 | A1 * | 3/2014 | Rodriguez | A43C 7/00 | 36/54 |
| 2014/0259773 | A1 * | 9/2014 | Johnson | A43C 19/00 | 36/96 |
| 2015/0272262 | A1 * | 10/2015 | Escamilla | A43B 3/36 | 36/137 |
| 2015/0289609 | A1 | 10/2015 | Gittens | | |
| 2016/0037863 | A1 * | 2/2016 | Harley | A43B 3/0031 | 36/72 R |
| 2016/0242493 | A1 * | 8/2016 | Stillwagon | A43C 5/00 | |
| 2018/0242680 | A1 | 8/2018 | Arin | | |
| 2018/0263330 | A1 * | 9/2018 | Rhoads | A43B 23/24 | |
| 2019/0053568 | A1 | 2/2019 | Choukeir | | |
| 2021/0022453 | A1 | 1/2021 | Gonzales | | |
| 2021/0330039 | A1 * | 10/2021 | Cureton | A43C 19/00 | |
| 2022/0031009 | A1 * | 2/2022 | Turnblom | A43B 5/145 | |

FOREIGN PATENT DOCUMENTS

| | | |
|---|---|---|
| KR | 10-0680852 | 2/2007 |
| KR | 10-2010-0027591 | 3/2010 |
| WO | 2015/054722 | 4/2015 |
| WO | 2019175916 | 9/2019 |

OTHER PUBLICATIONS

Retrieved on or about Dec. 15, 2019 Sneaker Jewelry https://www.trendhunter.com/trends/sneakerjewelry.
Photographed on or about Dec. 26, 2019 Gucci Crystal Sneaker Jewelry Sakes Fifth Avenue Department Store, New York.
Retrieved on or about Jan. 25, 2019 Gucci Flasktrek Jewelry https://www.nordstrom.com/s/gucci-flashtrekjewel-embellished-sneaker-women/5013856.
Retrieved on or about Jan. 25, 2019 Buscemi Sneaker https://buscemi.com/products/womens-100mmwhite.
Retrieved on or about Jan. 25, 2019 Giuseppe Zanotti Sneaker with Chain www.lyst.com.
Retrieved on or about Jan. 25, 2019 Giuseppe Zanotti Sneaker with Chain https://www.saksoff5th.com/product/giuseppe-zanottichained-eather-mid-topsneakers-0400013248463.html?
Photographed Feb. 7, 2019 Egyptian Tomb Gold Footwear Metropolitan Museum of Art.
Photographed Feb. 7, 2019 British Armor Metropolitan Museum of Art.
Photographed Feb. 7, 2019 Japanese Armor and Armor Footwear Metropolitan Museum of Art.
Retrieved Feb. 5, 2020 Indian Jewelry Instagram @hanut101.
Retrieved Feb. 14, 2020 Instagram @pierrehardy.
Retrieved on or about May 22, 2020 Crocs Decorative Adornment as seen on crocs.com https://www.crocs.com/c/jibbitz.
Retrieved on or about Jun. 20, 2020 Medieval Shoe Armor https://www.amazon.com/Medieval-Sabaton-Steel-Armor-Reenactment/dp/B06WWFCN8W.
Retrieved on or about Jun. 28, 2020 Michael Jackson stage performance armor wear as seen on: https://www.diamondsoulfactory.com/specialshows/michael-jackson/.
Retrieved on or about Jun. 28, 2020 Michael Jackson stage performance armor wear as seen on: https://www.pinterest.com/pin/169236898475043592/.
Retrieved on or about Jul. 28, 2020 Michael Jackson stage performance armor wear Twitter @Grammymuseum.
Retrieved on or about Jul. 2, 2020 Nike Jewelry Instagram @sneakernews.
Retrieved on or about Jul. 14, 2020 Nike Jewelry Instagram @sneakernews.
Retrieved on or about Aug. 28, 2020 Adidas Sneaker Jewelry Instagram @swaroski.
Retrieved on or about Sep. 10, 2020 Seen on Dior website under sneaker charms www.dior.com.
Retrieved on or about Sep. 21, 2020 Nike Sneaker Jewelry on Air Jordan Sneakers Instagram @sneakernews.
Retrieved on or about Dec. 27, 2020 Michael Jackson Cosplay Boot as seen on Pinterest: https://www.pinterest.com/pin/841117667880568618/.

(56) References Cited

OTHER PUBLICATIONS

Dool, Steve, "Marketing genius or madness? The man selling sneakers for $132K," CNN, Jan. 6, 2017 at https://www.cnn.com/style/article/buscemi-132kdiamond-sneakers/index.html.
Search report and written opinion for PCT/US21/42980, dated Dec. 27, 2021.
"STFLX MetGUARDZ? Metatarsal [and) Lace Protector (ProTecMel)" (Steel-Flex) Jan. 18, 2018 (Jan. 18, 2018) [online] retrieved from <URL: https://www.amazon.com/STLFLX- MetGUARDZ-Metatarsal-Protector-ProTecMet/dp/8079463CTH>.

* cited by examiner

PROTECTIVE SHOELACE COVER FOR FOOTWEAR

This application is a 371 of PCT/US2021/042980, filed on Jul. 23, 2021, published on Feb. 3, 2022 under publication number WO 2022/026324 and claims priority under 35 U.S.C. § 119 to U.S. Provisional Patent Application No. 63/057,614, filed on Jul. 28, 2020. The disclosure of these applications are incorporated herein by reference.

BACKGROUND

Field

The present disclosure relates to protective plates for covering the laces of a shoe or other footwear. In particular, the present disclosure relates to a plurality of plates for covering the laces of a shoe, wherein the plates are moveable with respect to one another to articulate as the shoe flexes.

Background

Decorative structures that attach to the laces of shoe generally include rings, loops, chains and other ornaments. These structures allow a user to accessorize the appearance of the shoe, add a logo or other identifying images, or include a mechanism to tighten and loosen the laces, for example, using a winding mechanism. These structures generally cover only a portion of the shoelace. None of these known shoelace-connected structures cover all or substantially all of the laces of the shoe. There is a need for structures that provide a protective covering to prevent materials and/or objects from impacting shoelaces.

There is a need to enhance the visibility of shoes, and particularly athletic shoes that may be worn at night while doing activities near roadways. Reflective shoe coverings are known. For example, some footwear includes reflective patches or decals that reflect light from car headlights to improve the safety of runners and joggers exercising at night. These patches are generally applied by the manufacturer. The design and appearance of these patches is generally fixed and cannot be changed by the user without permanently altering the shoe. Thus, there is a need for structures that can enhance the visibility of a shoe, while allowing a user to customize the appearance of the shoe without permanently altering the shoe.

SUMMARY

The present disclosure provides exemplary embodiments of a protective covering for a shoelace.

According to one aspect, there is provided a protective covering for a shoelace that includes a plurality of plates arranged along the portion of a shoe where laces are connected. According to one embodiment, these plates are connected with one another by flexible linkages. The linkages allow the plates to move relative to one another in the proximal and distal directions and to flex so that the flexibility of the user's foot is not limited. According to another embodiment, the linkages allow the plates to overlap one another and to slide past one another over a limited range of motion. According to another aspect, the linkages allow adjacent plates to rotate with respect to one another over a limited angular range. According to a further aspect, these linkages allow the plates to move and flex as the shoe to which they are connected moves and flexes as the wearer of the shoe walks, runs, dances, etc.

According to one embodiment, there is disclosed a lace protector for footwear comprising a plurality of plates arranged along a longitudinal axis, the axis extending from a proximal end to a distal end. One or more linkages connect adjoining pairs of the plurality of plates. One or more proximal connectors on a proximal-most plate of the plurality of plates is adapted to connect with an upper portion of a laced portion of the footwear. One or more distal connectors on a distal most plate of the plurality of plates is adapted to connect with a lower portion of the laced portion of the footwear. According to one embodiment the one or more linkages comprise two linkages connecting adjacent pairs of plates.

The one or more linkages may each comprise a first loop affixed to a distal-most plate of adjacent pairs of plates and extending in the proximal direction, and an engaging mechanism affixed to a proximal-most plate of the pairs of adjacent plates. The engagement mechanism may slideably engage with the first loop so that the pairs of adjacent plates so that the plates can move with respect to one another along the longitudinal axis. The engagement mechanism may comprise a second loop extending from a surface of the proximal-most plate of the pairs of adjacent plates with a leg of the second loop passing through an opening formed by the first loop. The engagement mechanism may also comprise a pin extending from a surface of the proximal-most plate of the pairs of adjacent plates and passing through an opening formed by the first loop. A stop may be provided at an end of the pin so that the first loop is captive on the pin between the surface of the proximal-most plate and the stop. The stop may comprise a pin head sized to keep the first loop captive on the pin. The stop may also comprise a crosspiece adapted to keep the first loop captive on the pin. The crosspiece and the pin may form a T-shape.

The one or more proximal connectors may be hooks or carabiners.

The one or more linkages may comprise one or more straps connecting pairs of adjacent plates. A proximal connection may be provided at a first end of the strap to a proximal-most plate of the pairs of adjacent plates and a distal connection may be provided at a second end of the strap to a distal-most plate of the pairs of adjacent plates. The proximal connection and the distal connection may each be a rivet, an adhesive, or a weld. The strap may be formed from a flexible material. The strap may be formed from an elastic material. The plurality of plates may be formed from a metal, a plastic, a ceramic, a glass, or combinations thereof. The metal may comprise one or more of copper, gold, silver, platinum, aluminum, brass, bronze, and combinations thereof.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1A:
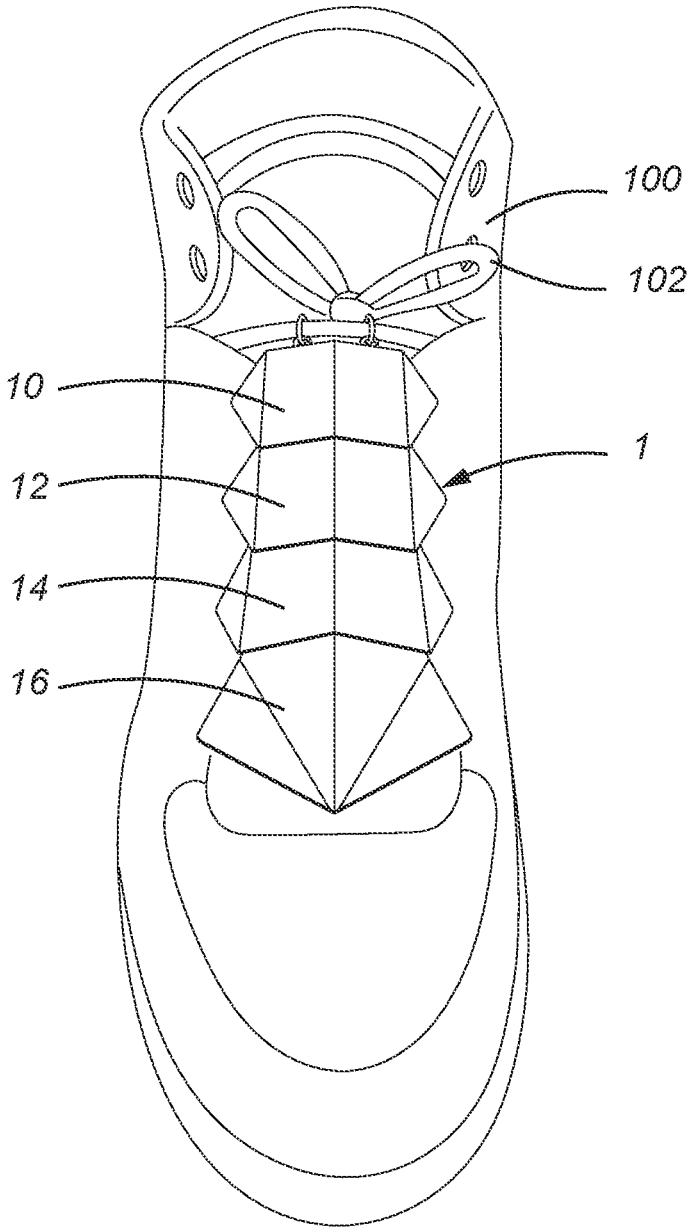
FIG. 1A is a front perspective view of protective shoelace cover according to an embodiment of the disclosure connected with a shoe.

FIG. 1A shows a perspective view of a shoelace protector 1 connected with a shoe 100 according to an embodiment of the disclosure. Lace protector 1 is composed of plates 10, 12, 14, 16 arranged along the length of the laces portion of the shoe. According to one embodiment, lace protector 1 connects with the lace at its proximal end and extends along a longitudinal axis past the distal end of the laced portion of the shoe. As used herein, the term "proximal" refers to the portion of a structure or object closest to the ankle of a shoe when the structure or object is arranged on the shoe. The term "distal" refers to the portion of a structure or object closest to the toe of a shoe when the structure or object is arranged on the shoe.

Figure 1B:
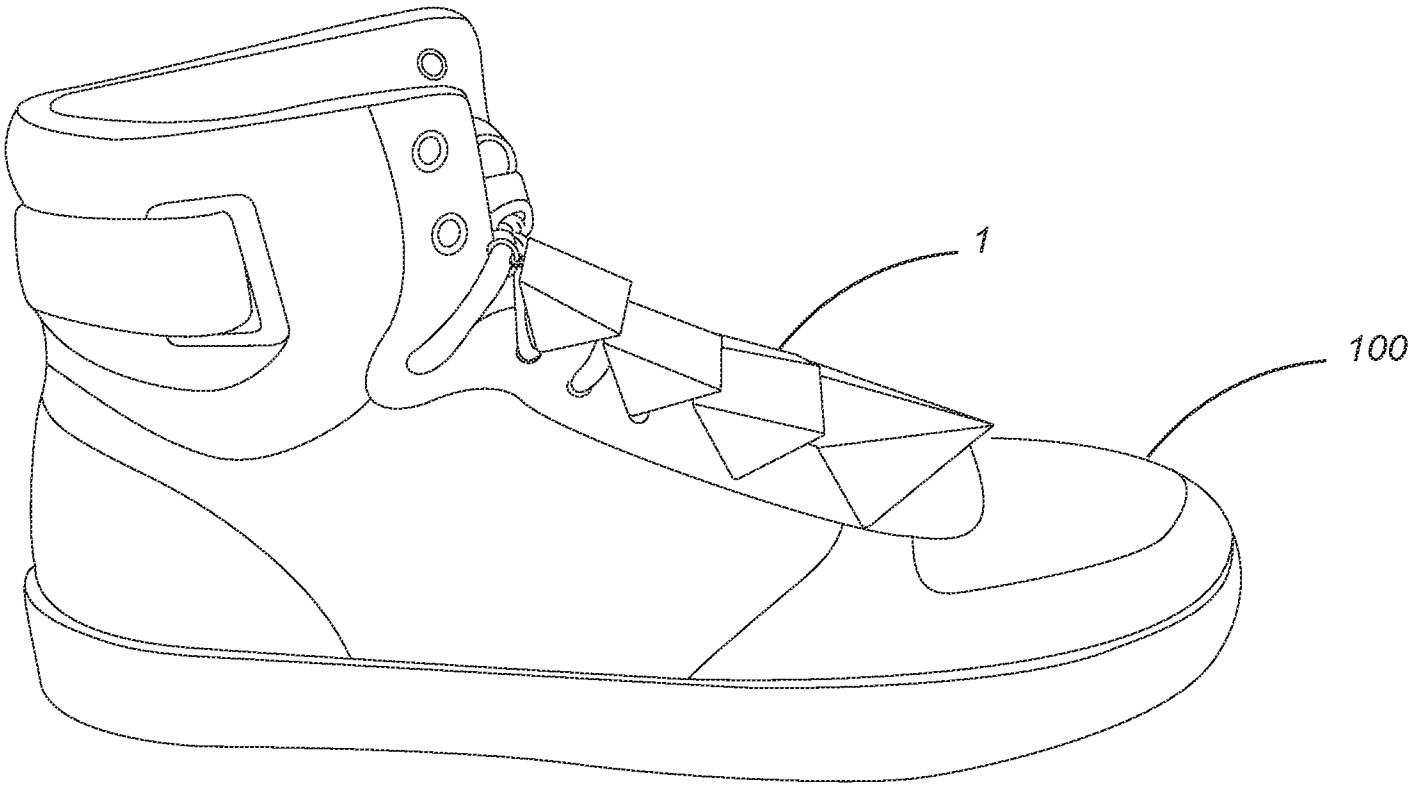
FIG. 1B is a side view of the shoelace cover of FIG. 1A.

As shown in FIGS. 1A and 1B, plates 10, 12, 14, 16 are shaped to partially conform to the shape of the laced portion of the shoe. According to this embodiment, central portions of the plates are bent along a centerline to form a convex upper surface and a concave lower surface. The plates may also include extensions extending from the central portions and that may also be bent to create a larger concavity. By forming a concavity on the lower side of the protector 1, the protector at least partially surrounds the laces, obscuring them from view and protecting them from impact. According to other embodiments, the plates have other shapes, for example, having a convex upper surface without a delineated centerline.

Plates 10, 12, 14, 16 may be formed from a metal, a plastic, a ceramic, a glass, or combinations thereof. According to a preferred embodiment, the plates are formed from one or more metals or metal alloys including but not limited to copper, gold, silver, platinum, titanium, aluminum, iron, nickel, zinc, tin, and their alloys including, but not limited to, stainless steel, brass, bronze, and combinations thereof. According to one embodiment, plates 10, 12, 14, 16 are formed from a metal, such as stainless steel coated with a ceramic.

Figure 2A:
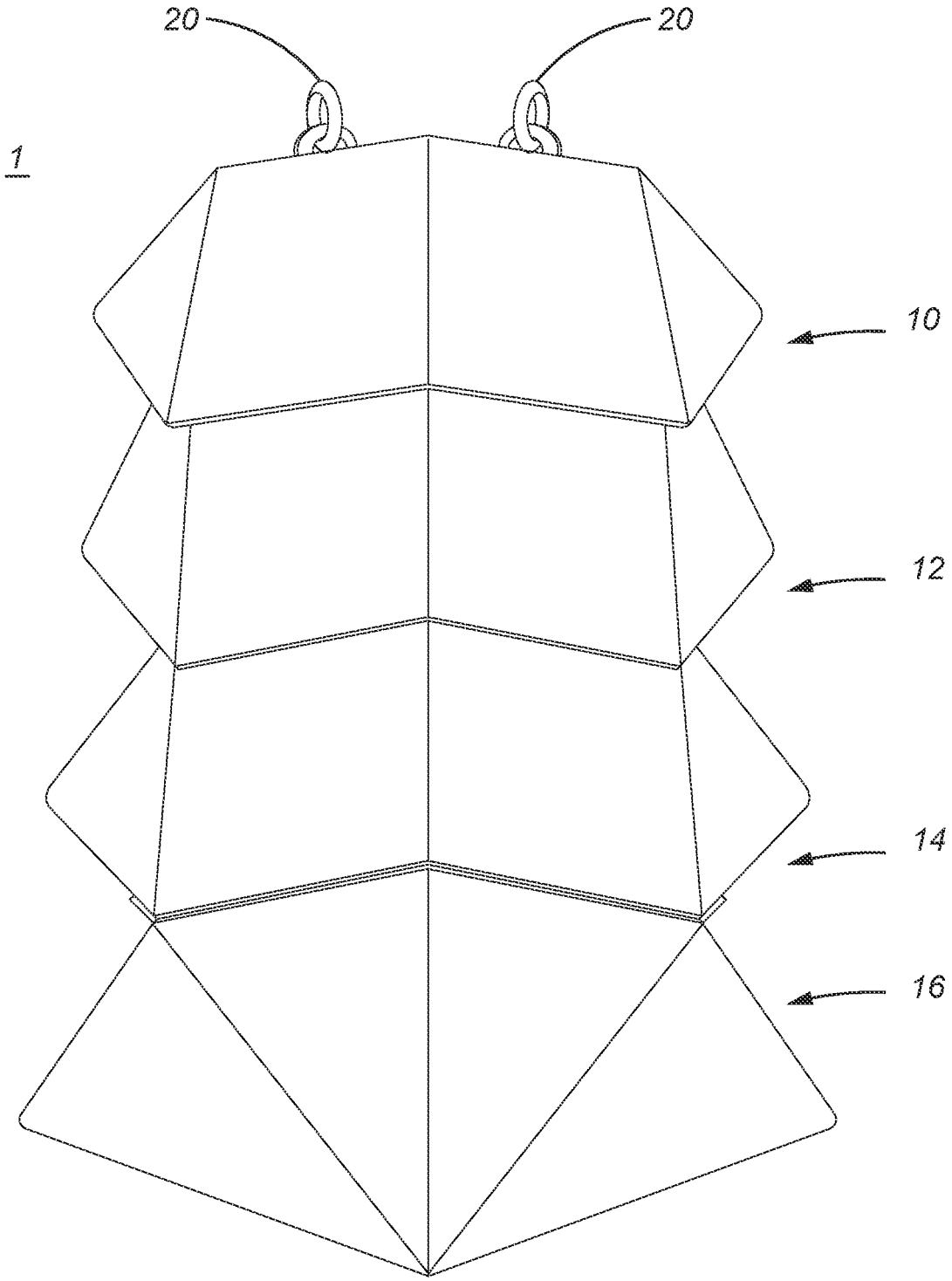
FIG. 2A is a top view of the shoelace cover of FIG. 1A.

As shown in FIG. 2A, at the proximal end of protector 1 are connectors 20. According to one embodiment, connectors 20 are shaped to allow the free ends of laces 102 to pass through and engage with the proximal end of the protector to affix the protector with the shoe 100. According to another embodiment, connectors 20 are hooks or openable clasps, such as carabiners, to allow protector 1 to be attached without untying the shoelace. According to one embodiment, instead of passing lace 102 through the connectors, the connectors are momentarily opened and fitted over the lace 1A to connect the proximal end of protector 1 with the lace.

Figure 2B:
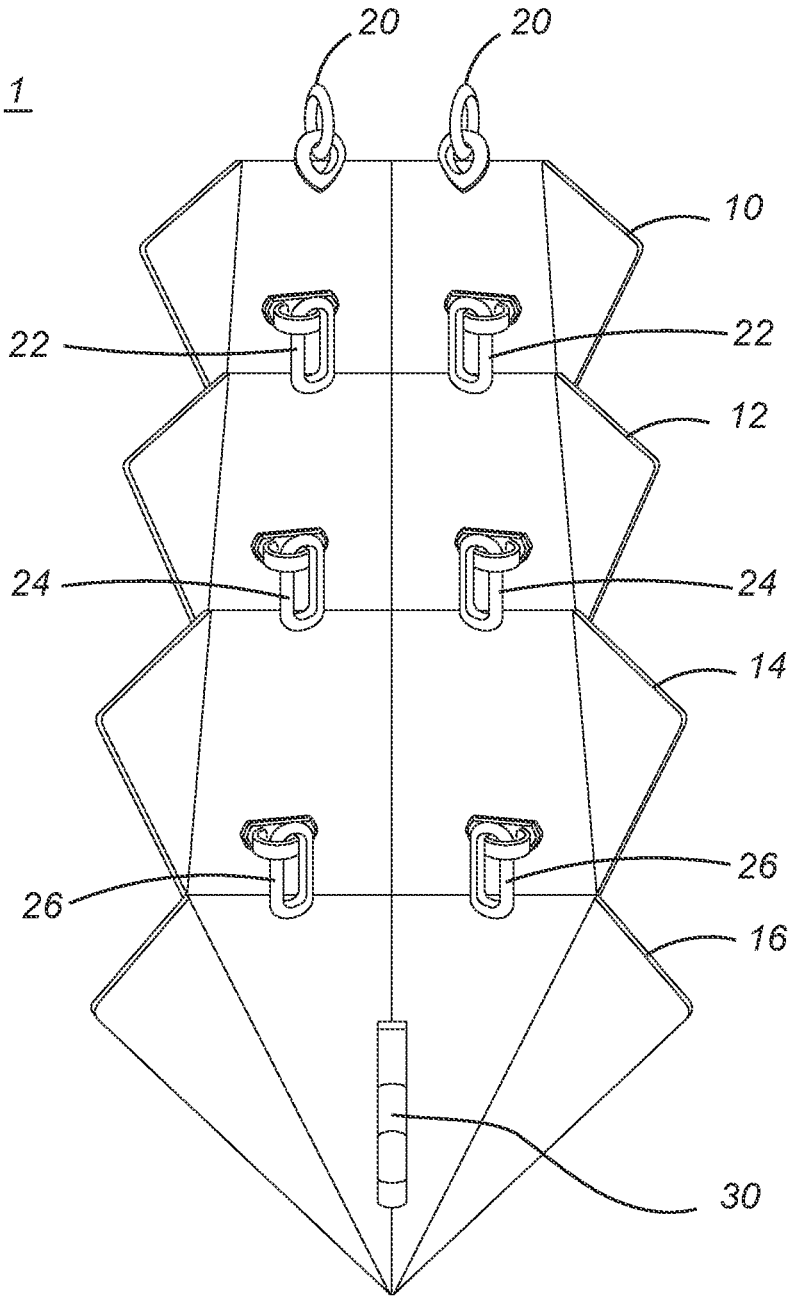
FIG. 2B is a bottom view of the shoelace cover of FIG. 1A.

FIG. 2B shows the lower side of protector 1. At or near the distal end of protector 1 is a distal connector 30 that projects from the lower surface of the distal-most plate 16. According to one embodiment, distal connector 30 is a clasp that allows protector 1 to removably connect with the distal end of the laced portion of the shoe. According to other embodiments, distal connector 30 connects with the laced portion of the shoe some distance from the distal end of the laced portion so that the protector is shorter than the laced portion of the shoe. This would leave some of the laced portion of the shoe exposed distal of the protector. According to some embodiments, connector 30 is a solid loop of material. To connect a protector according to this embodiment, lace 102 is fitted through the opening of connector 30 at the same time lace 102 is laced onto shoe 100. For this embodiment, to remove protector 1 from shoe 100, lace 102 needs to be unlaced from the shoe and lace 102 withdrawn from the loop of connector 30.

Figure 3A:
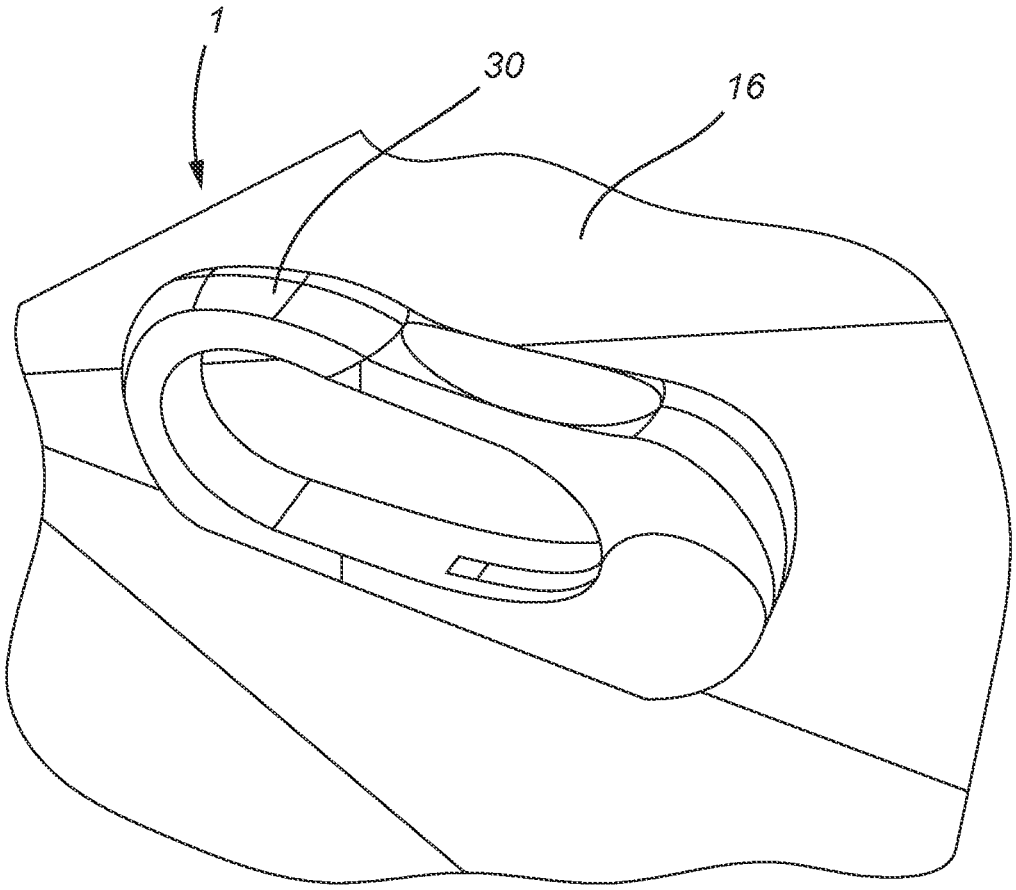
FIGS. 3A and 3B are detailed perspective views of a distal connector for a protective shoelace cover according to an embodiment of the disclosure.
Figure 3B:
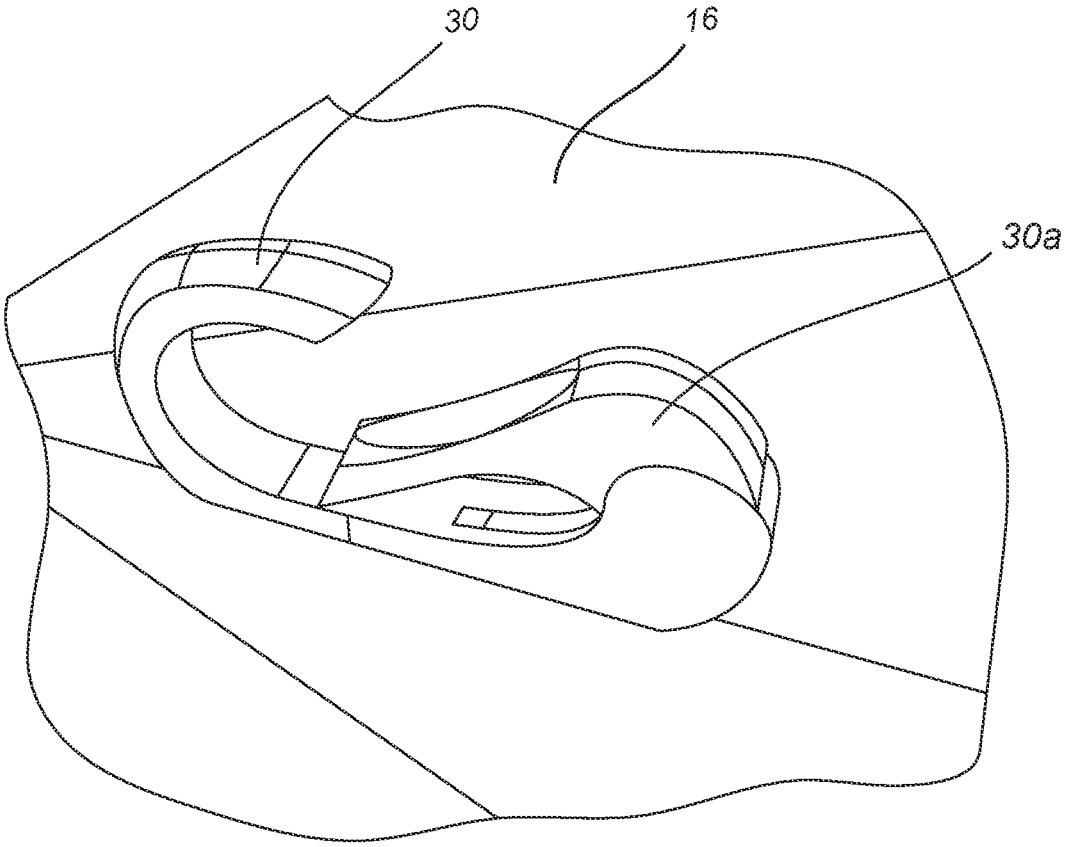

FIGS. 3A and 3B are detailed views of a distal connector 30 according to one embodiment of the disclosure. Connector 30 forms a loop extending along the longitudinal axis of the distal-most plate 16. Connector 30 is provided with a moveable arm 30*a*. Arm 30*a* is spring-loaded to hold it in the configuration shown in FIG. 3A, forming a loop engaged around lace 102. To connect connector 30 with lace 102, arm 30*a* is pressed inward to form an opening and lace 102 is inserted into the loop. When a user wishes to remove protector 1 from shoe 100, the used presses arm 30*a* inward, opening the loop and allowing lace 102 to disengage from connector 30. Connector 30 could be a push clasp, a carabiner clip, or "lobster claw" type clip. According to other embodiments, connector 30 could be a hook without moveable arm 30*a*.

As shown in FIG. 2B, plates 10, 12, 14, 16 are connected with one another by linkages 22, 24, 26 arranged on the lower surface of protector 1. In the embodiment shown in FIG. 2B, two linkages are provided between each pair of adjacent plates. According to other embodiments, a greater or lesser number of linkages may be provided between adjacent plates. Linkages 22, 24, 26 allow plates 10, 12, 14, 16 to slide and flex with respect to one another over a limited range of distance and angle. Adjacent plates, for example, plates 10 and 12 overlap one another. According to one embodiment, adjacent plates 10, 12 are arranged so that proximal-most plate 10 of each pair of adjacent plates 10, 12, is outward or above the distal-most plate 12 (as shown in the configuration in FIGS. 1A and 1B) of the pair of adjacent plates. As discussed more fully below, linkages 22, 24, 26 are arranged to allow adjacent plates to slide past one another by a limited distance, while maintaining a minimum amount of overlap between adjacent plates.

Figure 4A:
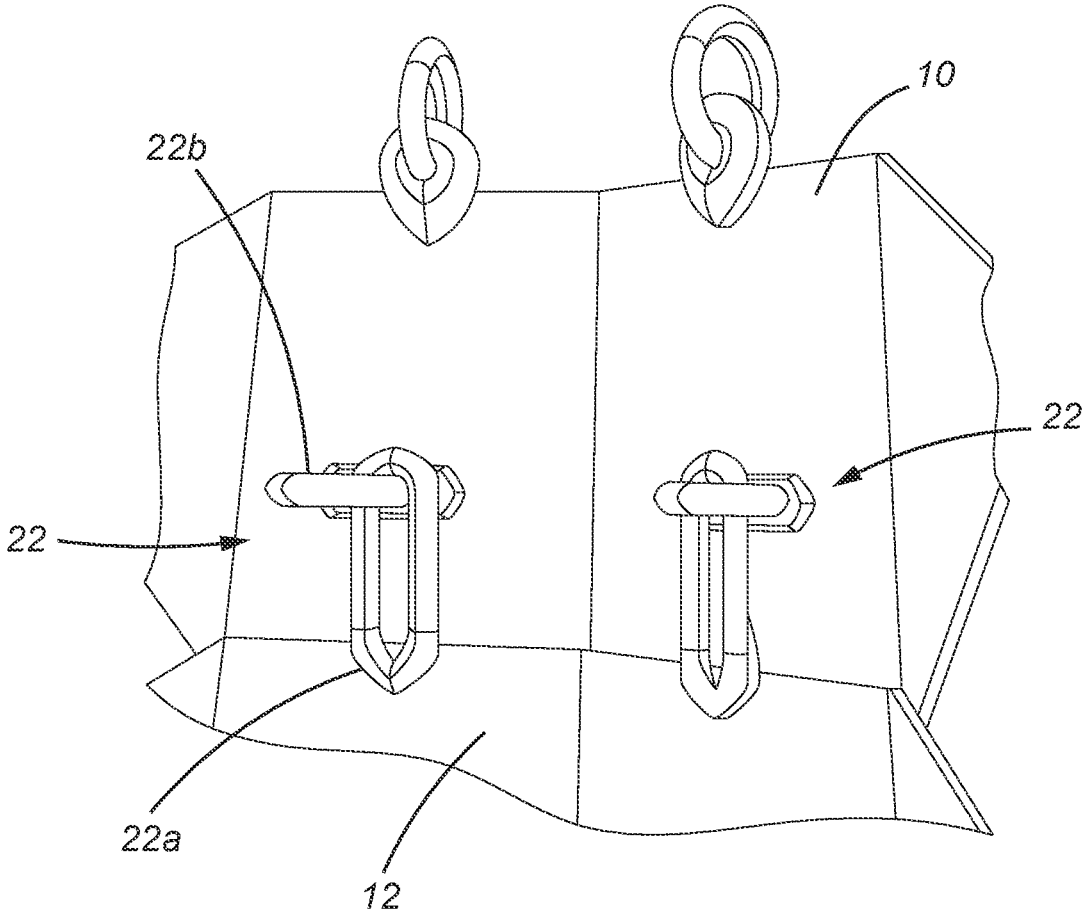
FIGS. 4A and 4B are detailed perspective views of linkages for a protective shoelace cover according to an embodiment of the disclosure.
Figure 4B:
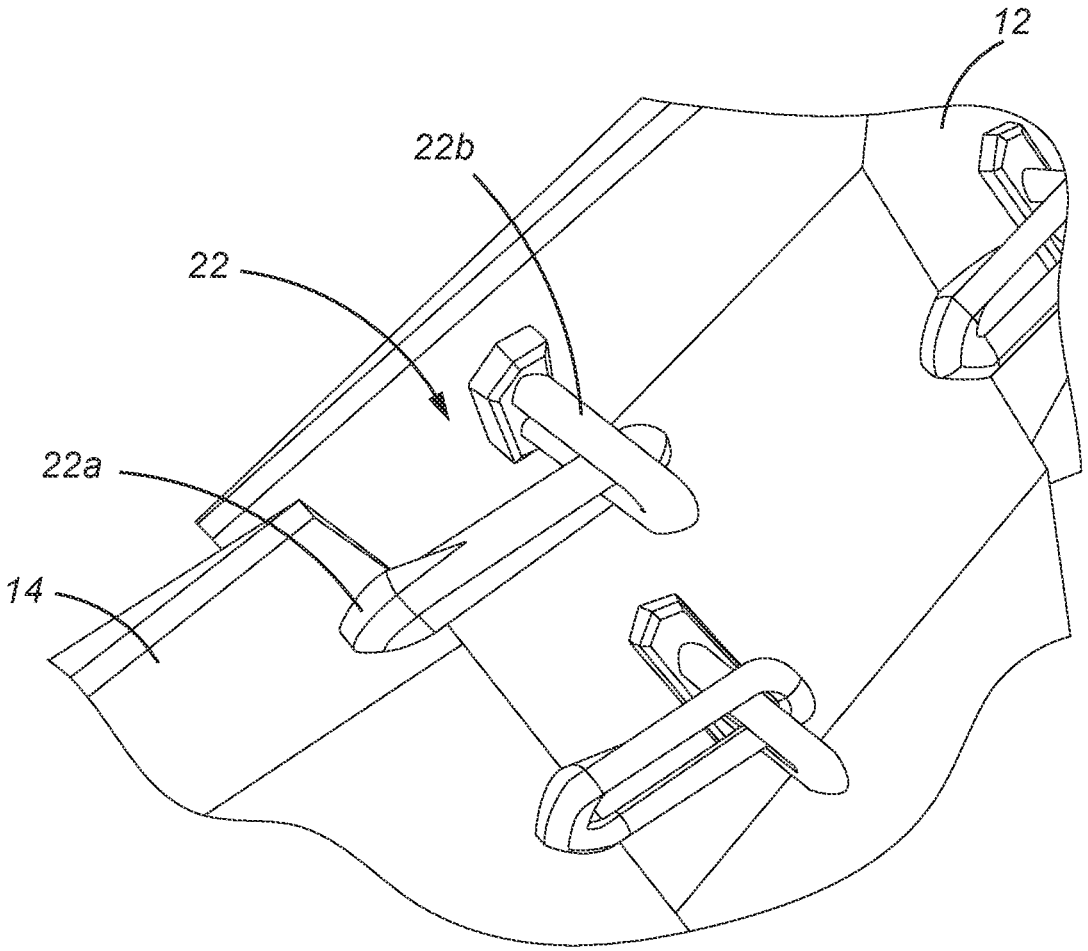

FIGS. 4A and 4B show a detailed view of linkages 22 according to one embodiment of the disclosure. Each linkage 22 is comprised of a longitudinal loop 22*a* and a transverse loop 22*b*. According to one embodiment, a distal end of longitudinal loop 22*a* is fixed to the proximal edge of plate 12 (the distal-most plate of the pair of adjacent plates 10, 12). Loop 22*a* extends in the proximal direction substantially parallel to the surface of plate 10. Transverse loops 22*b* are affixed to lower surfaces of plate 10 and extend perpendicular to those surfaces in a substantially transverse direction. Transverse loops 22*b* engage longitudinal loops 22*a* with one leg of the longitudinal loop passing through the opening of the transverse loop.

The opening of transverse loop 22*b* is large enough to allow the leg of longitudinal loop 22*a* to slide along the longitudinal direction. This allows adjacent plates 10, 12 to move with respect to one another. Engagement of the loops prevents the plates from sliding apart and maintains a minimum overlap between adjacent plates. This overlap assures that, when the protector 1 is connected with shoe 100, there is a continuous surface formed by the overlapping plates 10, 12, 14, 16 over the laced portion of the shoe. The proximal edge of distal-most plate 12 will contact transverse loop 22*b* when plate 12 moves in the proximal direction with respect to plate 10, thus limiting motion of plate 12 in the proximal direction. According to one embodiment, loops 22*b* include a base portion between the surface of the plate and the opening of the loop. This base keeps longitudinal loop 22*a* separate from the surface of plate 10 to provide clearance between the plates, allowing them to move easily past one another. As shown in FIG. 2B, the same arrangement of linkages is provided between each pair of adjacent plates, that is, between plates 12 and 14, and between plates 14 and 16.

According to one embodiment, two linkages 22 are provided between adjacent plates. Because linkages are independent of one another, adjacent plates are free to rotate with respect to one another over a limited range of angles with respect to the longitudinal axis of the protector.

FIG. 4B shows another detailed view of embodiments of linkages 22. As can be seen from the perspective view of transverse loops 22*b*, the openings of the loops are larger than the diameter of the leg of longitudinal loops 22*a*. As a result, longitudinal loops 22*a* can slide along the transverse direction. This arrangement allows adjacent plates (plates 12 and 14 in the view shown in FIG. 4B) to flex with one another. When protector 1 is arranged on a shoe, as shown in FIGS. 1A and 1B, the protector 1 is able to flex along with shoe 100, such as when a user wearing the shoe is walking or running. Also, because linkages allow plates 10, 12 14, 16 to slide, rotate, and flex with respect to one another, the protector according to some embodiments of the disclosure does not restrict movement of the user's foot during activities such as playing sports, dancing, and the like.

Figure 5A:
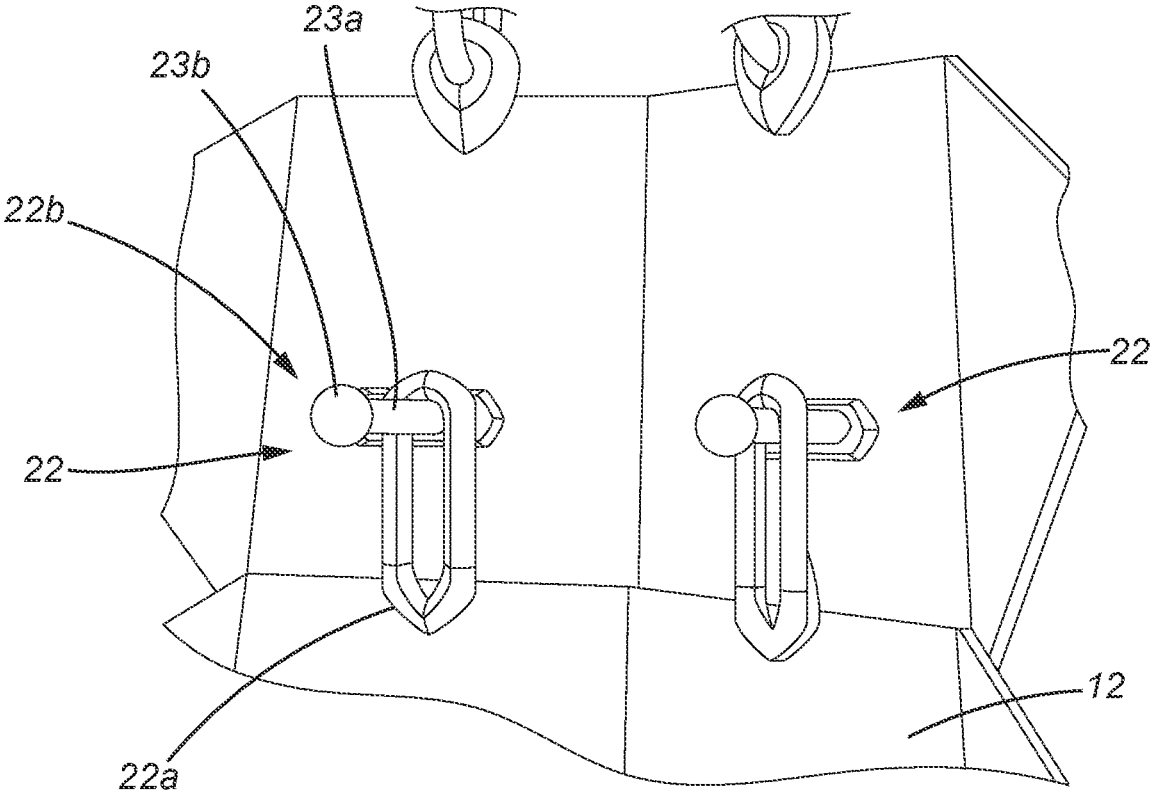
FIGS. 5A and 5B are detailed perspective views of linkages for a protective shoelace cover according to a further embodiment of the disclosure.
Figure 5B:
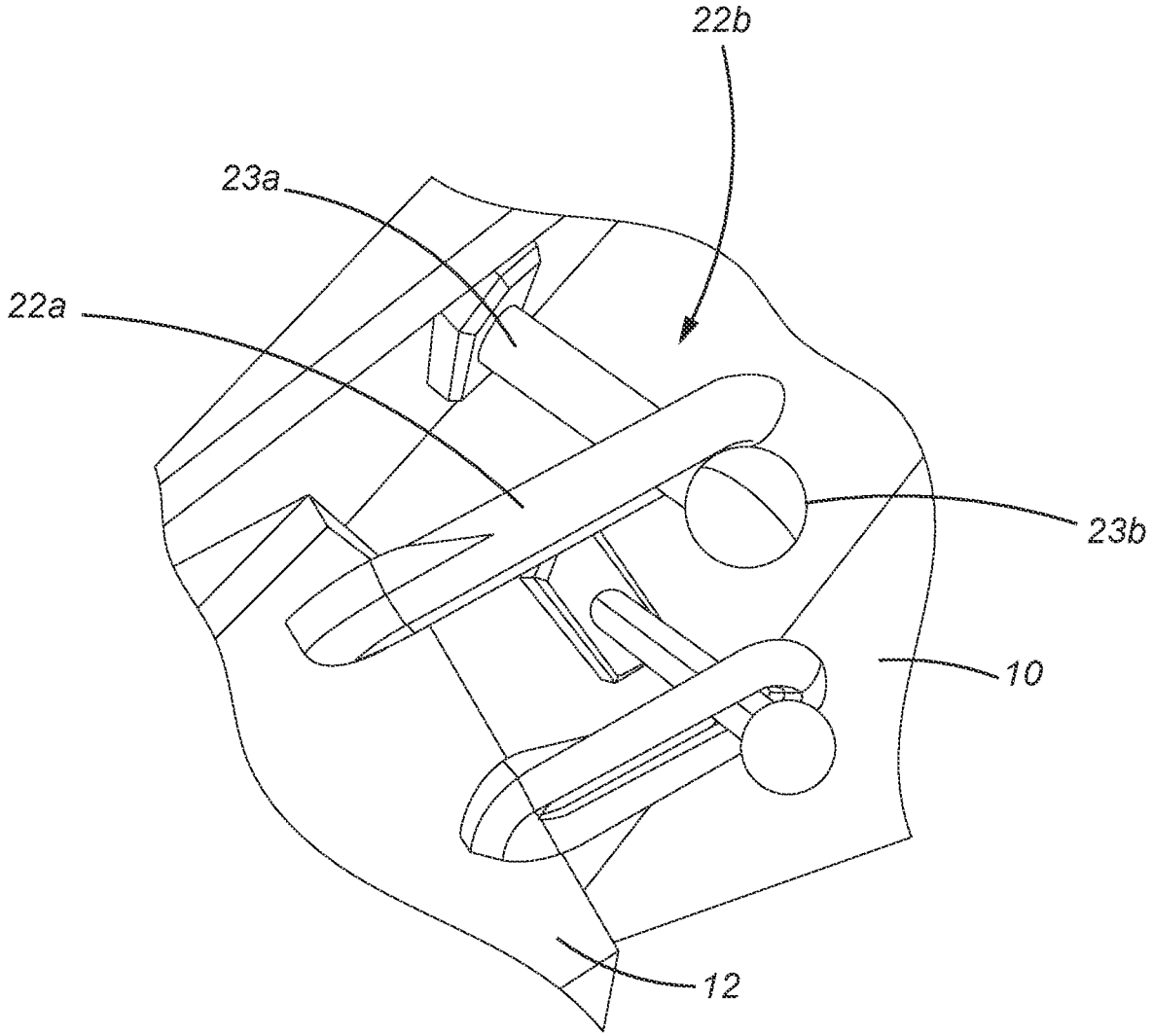

FIGS. 5A and 5B show another embodiment of the protector 1. Here, linkages 22 are formed by longitudinal loops 22*a* extending from the proximal edge of the distal-most plate of a pair of adjacent plates (here plate 12) as discussed in the embodiments shown in FIGS. 4A and 4B. In this embodiment, pins 22*b* extent perpendicular from the lower surface of the proximal-most plate (here plate 10) instead of transverse loops. Pin 22*b* has a shaft 23*a* that extends through the opening of loop 22*a*. The diameter of shaft 23*a* is smaller than the opening of loop 22*a*, allowing the adjacent plates to move with respect to one another in the manner discussed in previous embodiments. A pin head 23*b* is formed at the end of pin 23*a*. Pin head 23*b* is larger than the opening of loop 22*a*. As shown in FIG. 5B, loop 22*a* is captive on pin 22*b*.

Figure 6A:
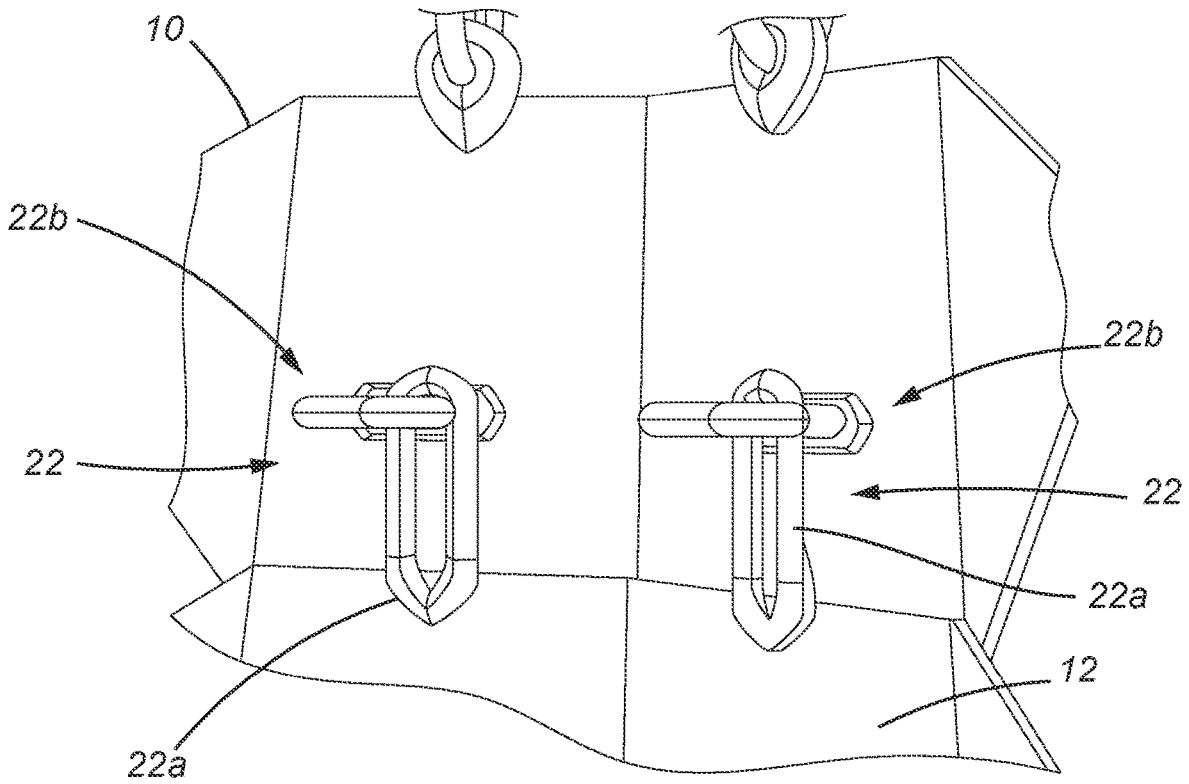
FIGS. 6A and 6B are detailed perspective views of linkages for a protective shoelace cover according to a still further embodiment of the disclosure.
Figure 6B:
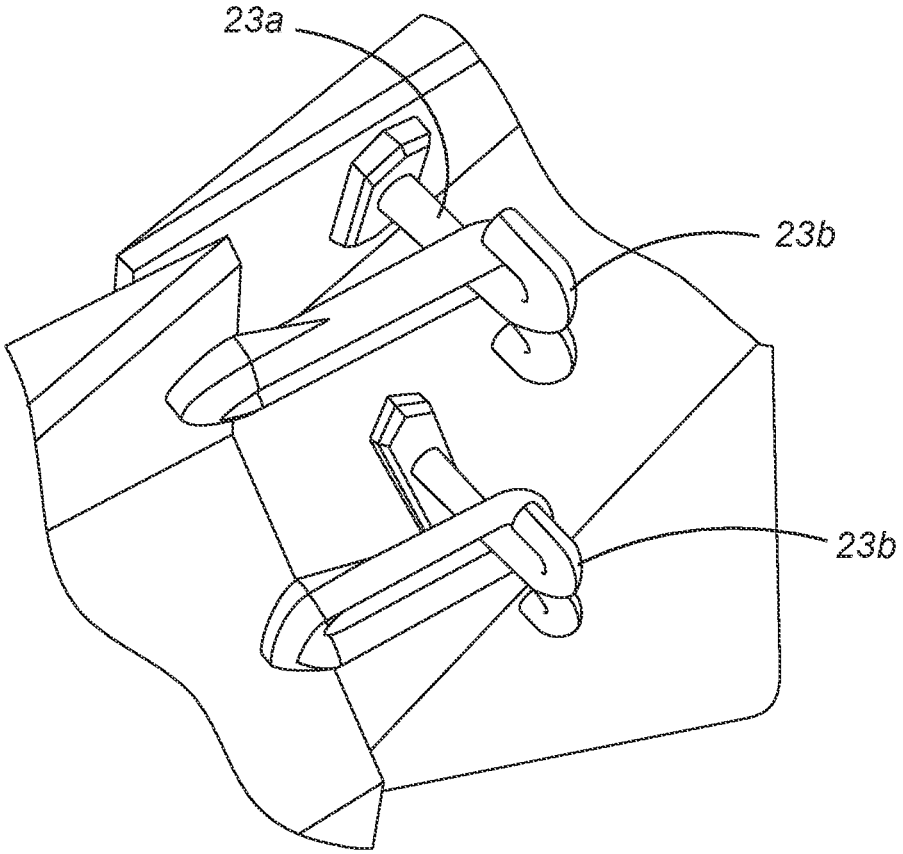

FIGS. 6A and 6B show another embodiment of the protector 1. Again, linkages 22 are formed by longitudinal loops 22*a* extending from the proximal edge of the distal-most plate of a pair of adjacent plates (here plate 12) as discussed in the previous embodiments. As discussed with respect to FIGS. 5A and 5B, pins 22*b* extent perpendicular from the lower surface of the proximal-most plate (here plate 10). Pin 22*b* has a shaft 23*a* that extends through the opening of loop 22*a*. The diameter of shaft 23*a* is smaller than the opening of loop 22*a*, allowing the adjacent plates to move with respect to one another in the manner discussed in previous embodiments.

In this embodiment, instead of a pin head at the end of shaft 23*a*, a crosspiece 23*b* is provided. Crosspiece 23*b* keeps loop 22*a* captive on pin 23*a*. According to one embodiment, crosspiece 23*b* includes arches shaped to conform with the legs of longitudinal loop 22*a*. According to other embodiments, crosspiece 23*b* is a straight member, such that pin 22*b* forms a T-shape.

Figure 7:
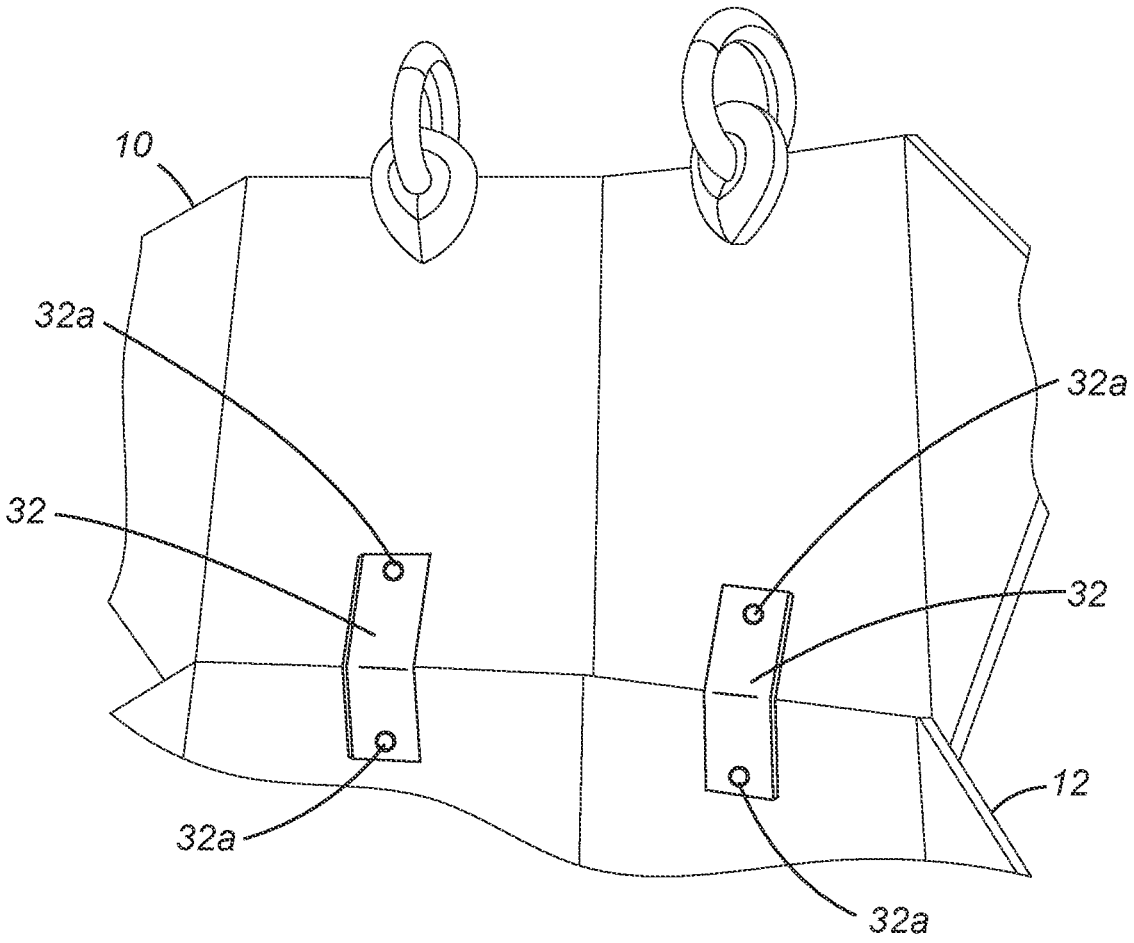
FIG. 7 is a detailed perspective views of linkages for a protective shoelace cover according to another embodiment of the disclosure.

FIG. 7 shows a further embodiment of the disclosure. In this embodiment, adjacent plates, for example, plates 10 and 12 are connected by straps 32 of material. Proximal and distal ends of the straps are attached to each plate, for example, by rivets 32*a*. Alternatively, ends of straps 32 may be attached to plates 10, 12 by welding, by adhesive, or by another attachment method known in the field of the invention. Straps 32 may be formed from a flexible material, such as a relatively thin metal or polymer. According to this embodiment, flexible straps 32 allow adjacent plates 10, 12 to flex with respect to one another as the footwear flexes. According to another embodiment, straps 32 are formed from an elastic material, such as an elastomeric polymer. Stretching of straps 32 allows plates 10, 12 to move proximally and distally with respect to one another and also to flex when the footwear flexes.

Figure 8:
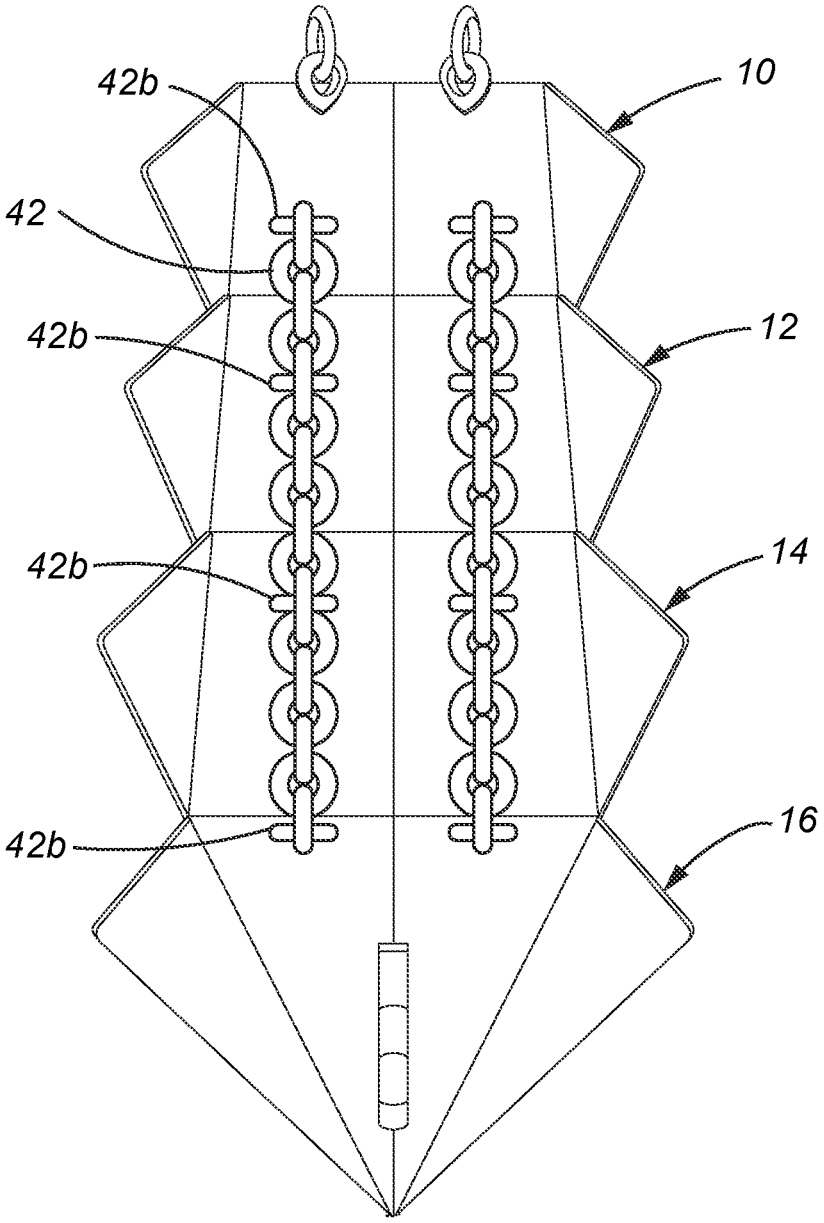
FIG. 8 is a bottom view of a shoelace cover according to a further embodiment of the disclosure.

According to a further embodiment, linkages are created by one or more chains extend another along the length of protector 1. FIG. 8 shows an embodiment of protector 1 where chains 42 connect plates 10, 12, 14, and 16 with one another and extend along a substantial portion of the bottom side of the protector. Chains 42 are connected with the plates by connection points 42*b*. According to one embodiment, a single connection point is made between chains 42 and each of the individual plates 10, 12, 14, 16. According to another embodiment, a plurality of connection points 42*b* are provided between chain 42 and each individual plate 10, 12, 14, 16. According to some embodiments, the length of the chain 42 and the distance between connection points 42*b* is selected so that the chain is relaxed and slightly loose to allow the plates to move and flex with respect to one another. According to one embodiment, connection points 42*b* are provided by formed by traverse loops, such as loops 22*b* as discussed above. Traverse loops engage with one or more linkages of chain 42. As with previous embodiment, the opening of traverse linkages 22*b* may be large enough for links of chain 42 to slide along the traverse linkage to allow the plates to bend and flex with respect to one another. According to another embodiment, connection points 42*b* are formed by welding one or more links of chain 42 to the bottom surface of respective plates 10, 12, 14, 16. The embodiment shown in FIG. 8 shows two chains 42 extending in parallel along the bottom surface of the protector. A greater or fewer number of chains 42 could be provided within the scope of the disclosure.

Figure 9:
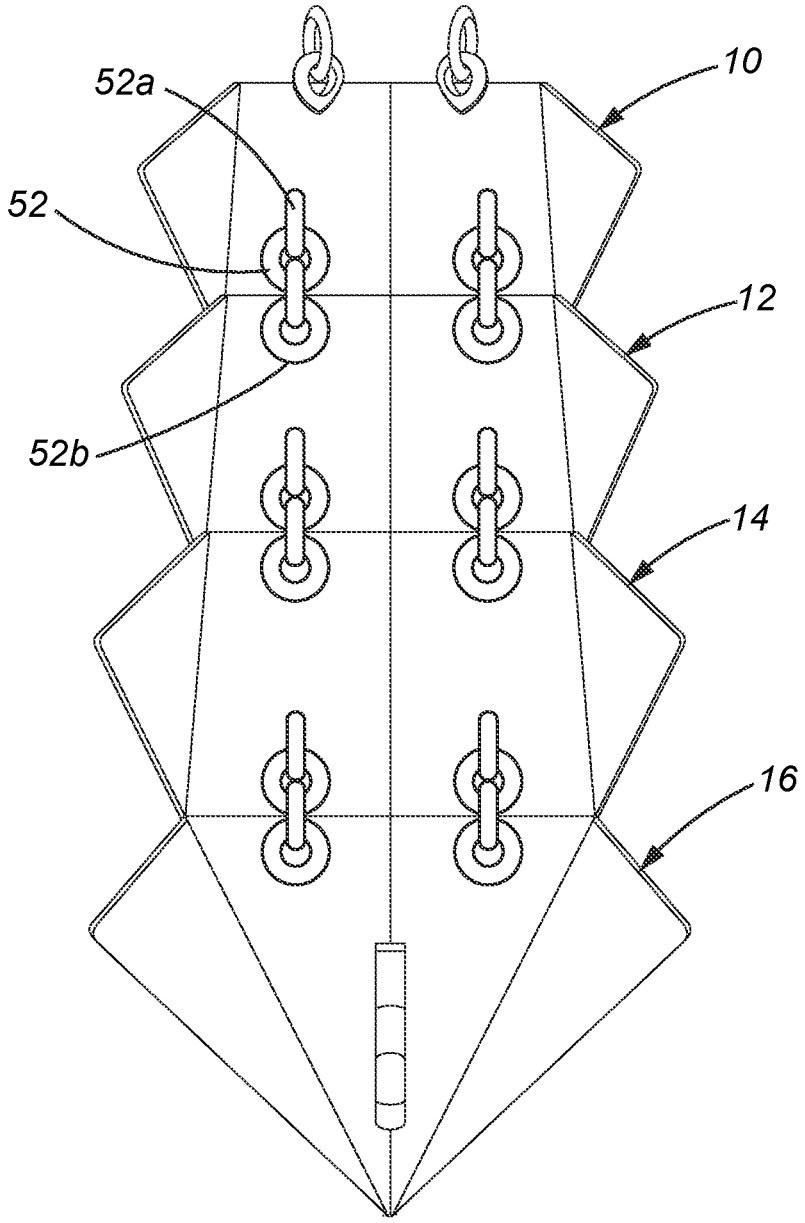
FIG. 9 is a bottom view of a shoelace cover according to a still further embodiment of the disclosure.

FIG. 9 shows a still further embodiment of protector 1. In this embodiment, linkages 52 are formed between pairs of adjacent plates, for example, plates 10 and 12, by a plurality of chain links that do not form a continuous chain. As shown in FIG. 9, four links are provided, with a proximal link connected with the proximal-most plate (e.g., plate 10) at connection point 52*a* and a distal link connected with the distal-most plate (e.g., plate 12) at a connection point 52*b*. As with previous embodiments, connection points 52*a*, 52*b* may be formed by transverse loops 22*b*. Alternatively, connection points 52*b* are formed by welding chain links with the bottom surface of plates 10, 12, 14, 16. The embodiment shown in FIG. 9 shows four chain links joining adjacent plates. A greater or fewer number of links may be provided within the scope of the disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. A lace protector for footwear comprising:

a plurality of plates arranged along a longitudinal axis, the axis extending in a direction from a proximal end of the lace protector to a distal end of the lace protector;

one or more linkages, the linkages connecting adjacent pairs of the plurality of plates;

one or more proximal connectors on a proximal-most plate of the plurality of plates, wherein the proximal connector is adapted to connect with an upper portion of a laced portion of the footwear and wherein the one or more linkages constrain pairs of adjacent plates to move with respect to one another a predetermined distance along the longitudinal axis; and one or more distal connectors on a distal most plate of the plurality of plates, wherein the distal connector is adapted to connect with a lower portion of the laced portion of the footwear.

2. The lace protector of claim 1, wherein the one or more linkages comprise two linkages connecting adjacent pairs of plates.

3. The lace protector of claims 1, wherein the one or more linkages each comprise a first loop affixed to a distal-most plate of adjacent pairs of plates and extending in the proximal direction, and an engaging mechanism affixed to a proximal-most plate of the pairs of adjacent plates, wherein the engagement mechanism slideably engages with the first loop and wherein the pairs of adjacent plates can move with respect to one another along the longitudinal axis.

4. The lace protector of claim 3, wherein the engagement mechanism comprises a second loop extending from a surface of the proximal-most plate of the pairs of adjacent plates, a leg of the second loop passing through an opening formed by the first loop.

5. The lace protector of claim 3, wherein the engagement mechanism comprises a pin extending from a surface of the proximal-most plate of the pairs of adjacent plates through an opening formed by the first loop, and a stop at an end of the pin, wherein the first loop is captive on the pin between the surface of the proximal-most plate and the stop.

6. The lace protector of claim 5, wherein the stop comprises a pin head sized to keep the first loop captive on the pin.

7. The lace protector of claim 5, wherein the stop comprises a crosspiece adapted to keep the first loop captive on the pin.

8. The lace protector of claim 7, wherein the crosspiece and the pin form a T-shape.

9. The lace protector of claim 1, wherein the one or more proximal connectors are hooks or carabiners.

10. The lace protector of claim 1, wherein the one or more linkages comprise one or more straps connecting pairs of adjacent plates, wherein a proximal connection is provided at a first end of the strap to a proximal-most plate of the pairs of adjacent plates and a distal connection is provided at a second end of the strap to a distal-most plate of the pairs of adjacent plates.

11. The lace protector of claim 10, wherein the proximal connection and the distal connection are each a rivet, an adhesive, or a weld.

12. The lace protector of claim 10, wherein the one or more straps are formed from a flexible material.

13. The lace protector of claim 10, wherein the one or more straps are formed from an elastic material.

14. The lace protector of claim 1, wherein the plurality of plates are formed from a metal, a plastic, a ceramic, a glass, or combinations thereof.

15. The lace protector of claim 14, wherein the metal comprises one or more of copper, gold, silver, platinum, titanium, aluminum, iron, nickel, zinc, tin, and alloys and combinations thereof.

16. The lace protector of claim 1, wherein the one or more linkages each comprise a plurality of chain links extending in a longitudinal direction, wherein selected ones of the chain links are joined with respective ones of the plurality of plates at one or more connection points.

17. The lace protector of claim 16, wherein the linkages comprise a continuous chain arranged along bottom surface of the protector.

* * * * *